United States Patent [19]

McCall et al.

[11] 4,021,986

[45] May 10, 1977

[54] MODULAR CEILING FRAMEWORK

[75] Inventors: Francis L. McCall, Hacienda Heights; Joel E. Taylor, III, Pasadena, both of Calif.

[73] Assignee: Specified Ceiling Systems, Alhambra, Calif.

[22] Filed: Apr. 18, 1975

[21] Appl. No.: 569,287

[52] U.S. Cl. ..... 52/475; 52/484

[51] Int. Cl.[2] ..... C04B 5/52

[58] Field of Search ..... 52/475, 484, 485, 496, 52/729, 495, 494, 758 A

[56] References Cited

UNITED STATES PATENTS

| | | | |
|---|---|---|---|
| 2,910,738 | 11/1959 | McCorkell | 52/495 |
| 3,084,401 | 4/1963 | Findlay | 52/484 |
| 3,138,229 | 6/1964 | Hubbard | 52/496 |
| 3,388,519 | 6/1968 | Downing | 52/495 |
| 3,583,119 | 6/1971 | Kann | 52/484 |
| 3,708,932 | 1/1973 | Bailey | 52/484 |
| 3,835,614 | 9/1974 | Downing | 52/484 |
| 3,846,031 | 11/1974 | Adams | 52/484 |
| 3,890,753 | 6/1975 | Johansen | 52/500 |
| 3,890,760 | 6/1975 | Jones | 52/758 |

FOREIGN PATENTS OR APPLICATIONS

| | | | |
|---|---|---|---|
| 89,165 | 6/1960 | Denmark | 52/484 |
| 2,033,505 | 10/1971 | Germany | 52/495 |
| 1,020,471 | 2/1966 | United Kingdom | 52/495 |
| 1,037,931 | 8/1966 | United Kingdom | 52/495 |

*Primary Examiner*—Price C. Faw, Jr.
*Assistant Examiner*—Henry Raduazo
*Attorney, Agent, or Firm*—Christie, Parker & Hale

[57] ABSTRACT

A modular framework for a drop ceiling constructed from sheet steel strips in which individual frame members are rolled from a single strip into a cross-sectional shape including a hollow rectangular bulb portion, a flat web portion formed from two thicknesses of the sheet metal strip extending from the center of one wall of the rectangular portion, and a pair of L-shaped portions having one leg of each L-shaped portion lying in a common plane transverse to the web portion and joined respectively to the two thicknesses of the web portion, with the other leg of each L-shaped portion extending parallel to the web and projecting away from the bulb portion. Ends of the web portion have tabs which stab into openings of the web portion of another frame member to form a T connection between cross-members.

3 Claims, 8 Drawing Figures

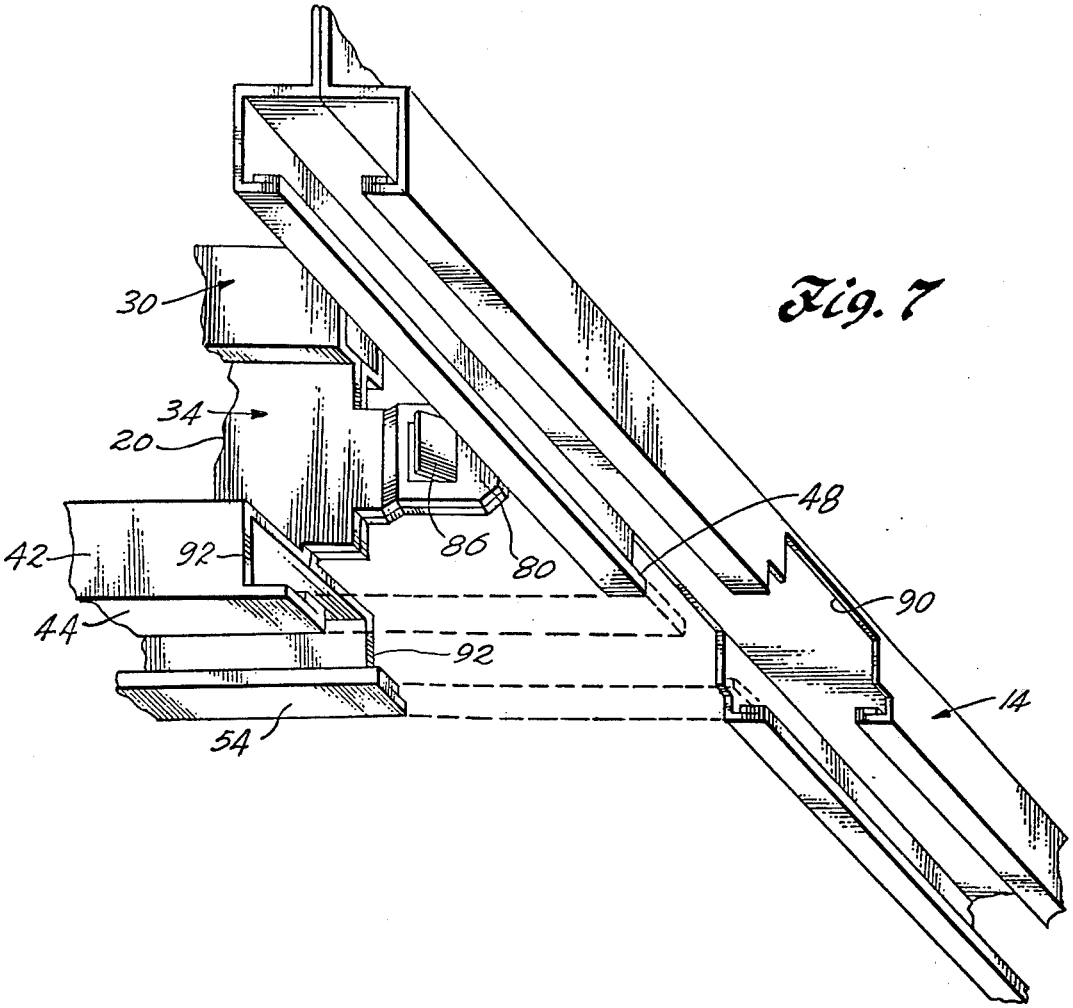
Fig. 7
Fig. 8
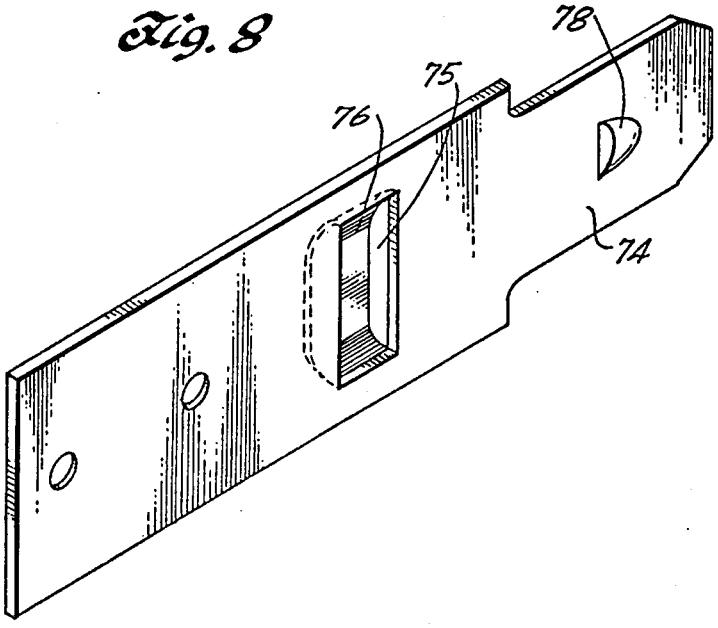

MODULAR CEILING FRAMEWORK

FIELD OF THE INVENTION

This invention relates to structural members for constructing the framework of a modular drop ceiling.

BACKGROUND OF THE INVENTION

The use of drop ceilings in building construction is well known. One mode of construction for drop ceilings is to provide a metal framework with longitudinal runners and lateral cross-members which fit together in a lattice network. Standard openings have modular sizes of 2 feet × 2 feet squares or 2 feet × 4 feet rectangles. The modular framework is supported on hangers from the overhead structure and the framework is used to support acoustical tile panels, flourescent light fixtures, ventilation fixtures, and the like.

In the past, both steel grid systems and extruded aluminum grid systems have been available. The steel grid systems have been constructed from lengths of T-shaped members which are roll-formed out of sheet steel stock. LSince the acoustical panels rest on top of the inverted T frame members, the bottom surface of the T is offset from the surface of the acoustical panels. This is not particularly desirable where movable partition type walls are used, since a gap is formed between the top of the partition and the surface of the acoustical panel to allow for the thickness of the inverted T-shaped member. Moreover the flat surface of the cross portion of the T that is exposed is relatively wide to achieve stiffness and because of its width does not make a particularly pleasing appearance in outlining the grid structure of the drop ceiling.

Drop ceiling frameworks have also been provided which are made from extruded aluminum. Interlocking of aluminum frame joints presents a somewhat different problem in that either separate clips must be provided for connecting the parts or interlocking integral tabs provided that must be bent to lock the parts together. Aluminum extrusions have the additional disadvantages in that they are not fire resistive and cannot be fire rated. Also, if contrasting tones are desired, the aluminum must be painted after fabrication, by masking techniques, greatly adding to the cost. Thermal expansion is a problem in large floor plans.

SUMMARY OF THE INVENTION

The present invention provides an improved structure for a drop ceiling grid or framework in which the structural members are rolled from sheet steel strips that are prepunched to provide desired end shapes and holes. A structure is achieved which overcomes the above problems with both the steel T-shaped frames and the extruded aluminum type ceiling structures, while retaining the best features of both. The ends of the cross-members are formed with integral clips which allow them to snap onto the longitudinal runners and lock in place in a manner which prevents any twisting or rotation of the cross-members while eliminating the need for any separate clips, brackets, or the like. This is accomplished, in brief, by providing a frame member comprising an elongated sheet steel strip rolled into a cross-sectional shape including a hollow rectangular bulb portion, a web portion formed from two thicknesses of the sheet metal strip projecting from the center of one wall of the rectangular bulb portion, and a pair of L-shaped portions having one leg of each L-shaped portion lying in a common plane transverse to the web portion and joined respectively to the two thicknesses of the web portion, the other leg of each L-shaped portion extending parallel to the web and projecting away from the rectangular portion, the edges of the L-shaped portions being turned inwardly toward each other. The strip can be prepainted with contrasting colors on the two sides of the strip before it is rolled into the desired structural shape. Also, the strip can be pre-punched or cut to provide the necessary holes and end shapes for connecting the members into a grid and to provide the desired modular spacing or length. One end of the cross-members is formed with the two thicknesses of the web projecting longitudinally beyond the rectangular portion and the L-shaped portions to form a projecting connector tab, the tab extending parallel to but offset from the longitudinal major surfaces of the web. The tab portion has a cantilevered integrally formed spring clip which locks the tab in place when it is inserted through a hole in an adjoining longitudinal member.

DESCRIPTION OF THE DRAWINGS

For a more complete understanding of the invention reference should be made to the accompanying drawings, wherein:

FIG. 7 is a perspective view showing the manner in which cross-members lock in at the ends to a longitudinal runner; and FIG. 8 is a detail view of the end clip for joining abutting runners.

DETAILED DESCRIPTION

Figure 1:
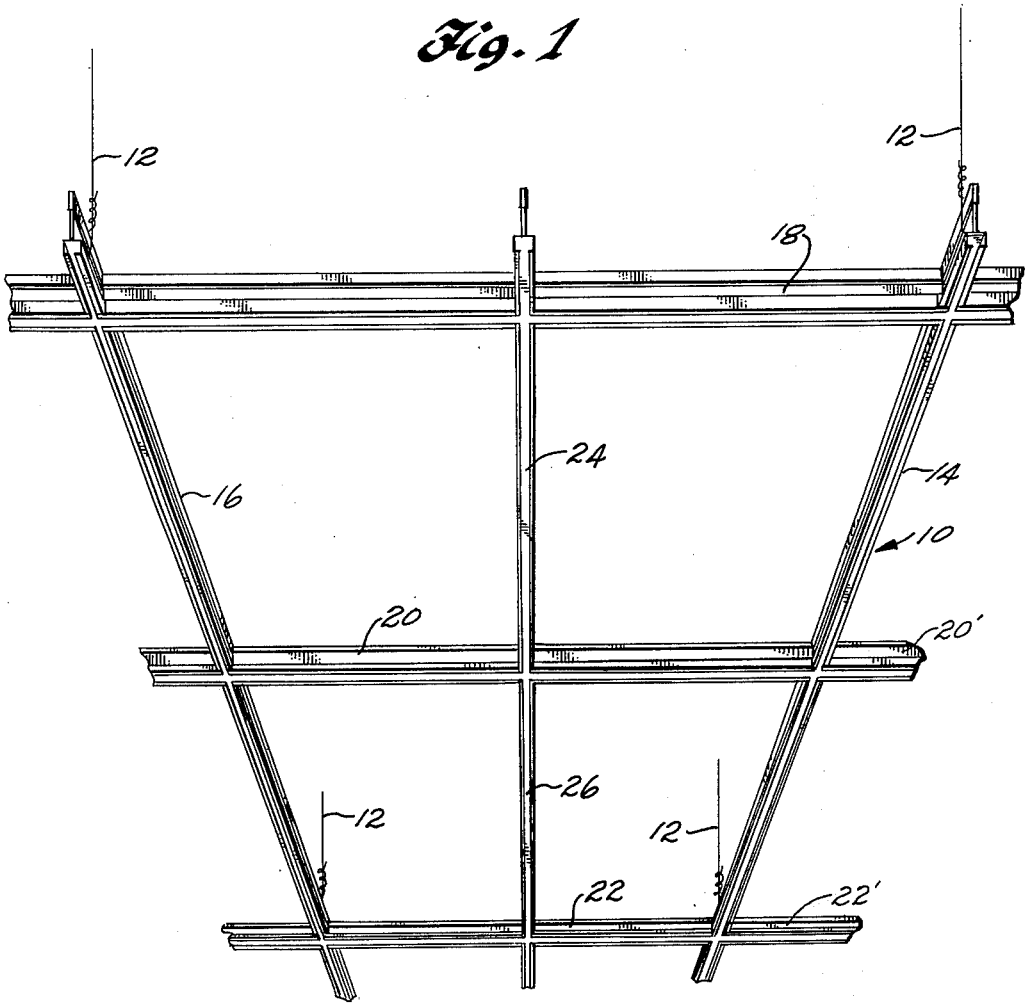
FIG. 1 is a perspective view of the drop ceiling framework incorporating the features of the present invention.

Referring to the drawings in detail, the numeral 10 indicates generally an assembled framework forming the grid of a drop ceiling. The grid, when assembled, is supported from the overhead structure of the building by hanger wires 12. The hanger wires are attached at intervals along main longitudinal runners, two of which are indicated at 14 and 16. The main runners are prefabricated typically in lengths of 12 feet and normally are spaced on 4 feet centers. The runners 14 and 16 are joined by cross-members, as indicated at 18, 20 and 22, which are prefabricated in 4 feet lengths and are joined at their ends to the longitudinal runners 14 and 16 in a manner hereinafter described. Typically the cross-members 18, 20, and 22 are spaced at 2 feet intervals, making a grid work of 2 feet × 4 feet openings. If desired, additional short members 24 and 26 may be inserted between the cross-members 18 and 20 and between the cross-members 20 and 22 to form 2 feet × 2 feet square modules.

Figure 2:
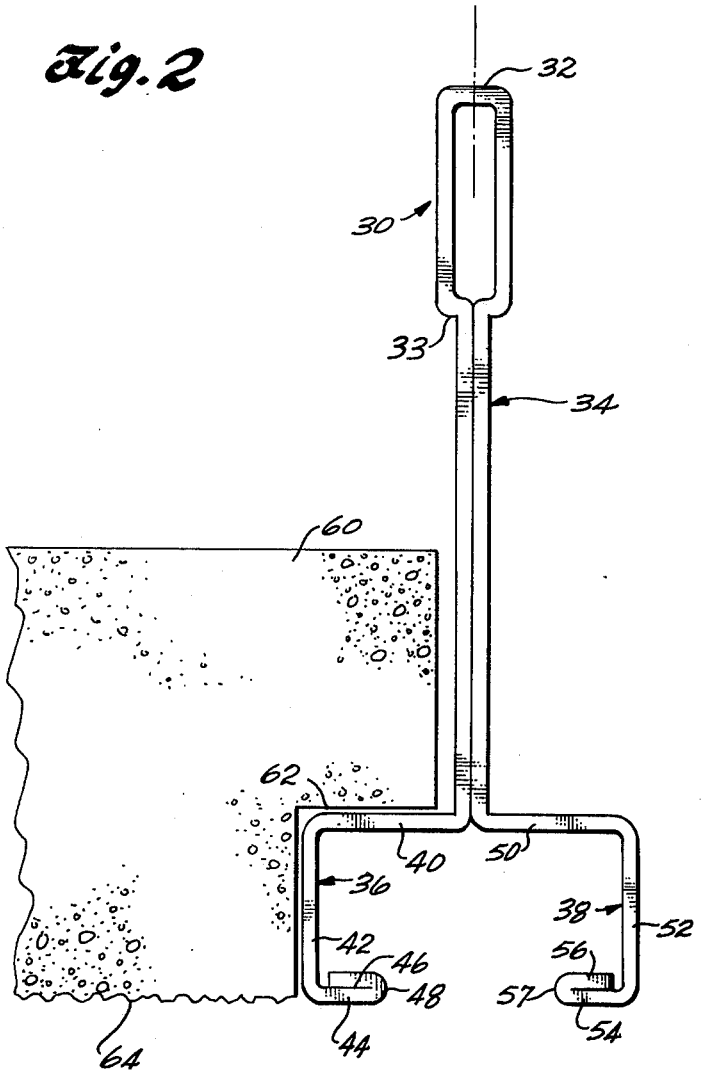
FIG. 2 is an end view of one of the frame members.
Figure 4:
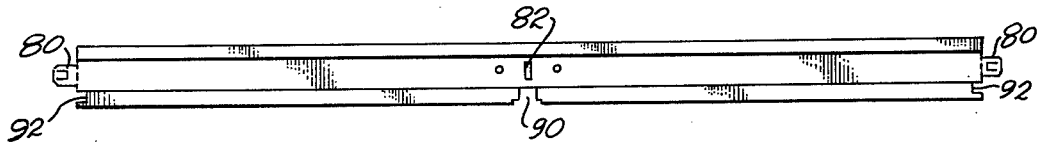
FIG. 4 is a side view of a cross-member showing the tab connectors at the end.

Referring to FIG. 2, the structural members of the framework are formed out of strips of sheet steel by rolling each strip into the cross-sectional shape as shown. By way of example only, the sheet metal strip may be 0.024 inches in thickness. The center portion of the strip is rolled into a hollow rectangular shape to form a bulb portion 30 which is rectangular in cross section with the longitudinal centerline of the sheet metal strip corresponding to the center of the top surface 32 of the bulb portion 30. Integrally joined to the bottom 33 of the rectangular bulb portion 30 is a web portion 34 formed by folding the two halves of the sheet metal strip at the center of the bottom surface 33 of the bulb portion 30 against each other to form a web 34 of double thickness of the sheet metal strip.

The lower margin of the web portion 34 terminates in a pair of L-shaped portions 36 and 38. The upper leg 40 of the L-shaped portion 36 is integral with the lower edge of the web portion. The other leg portion 42 of the L-shaped portion 36 extends downwardly parallel to the web portion 34. The lower edge of the L-shaped portion 36 is rolled inwardly to form a lip 44 and is then folded back on itself, as indicated at 46, to provide additional rigidity and to provide a smooth, rounded inner edge 48.

The L-shaped portion 38 is similarly provided with the leg 50 lying in a common transverse plane with the leg 40 of the L-shaped portion 36. The other leg 52 extends downwardly and terminates in a lip 54 which is folded back on itself at 56 to form a smooth inner edge 57. The legs 40 and 50 of the L-shaped portions 36 and 38 provide ledges on which are supported acoustical tiles, for example, such as indicated at 60. One edge of the acoustical tile is indented to form a supporting surface 62 while permitting the bottom surface 64 to be flush with the inwardly turned lips 44 and 54 of the frame member.

The frame members are roll-formed into the shape described above in connection with FIG. 2 by standard roll-forming techniques. By preparing or coating the surfaces of the sheet metal strip with contrasting colors after rolling, the interior surfaces of the L-shaped portions form a contrasting color to the reveal provided by the outer surfaces of the inwardly projecting lips 44 and 54, thus giving a pleasing visual effect.

Figure 3:
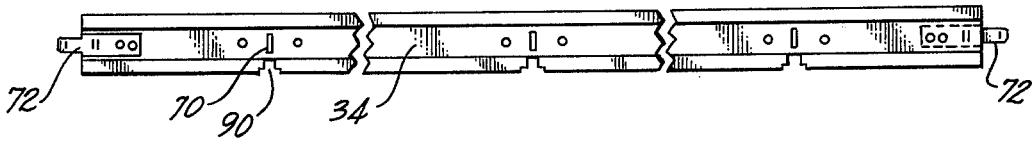
FIG. 3 is a side view of a longitudinal runner.

Referring to FIG. 3, a main runner section is shown which typically is 12 feet in length. The web portion 34 is provided with rectangular pre-punched openings 70 which preferably are spaced at 2 feet intervals and 1 foot from either end of the runner. The ends of the runner are provided with separate clips 72 that are riveted or spot welded in place. As shown in FIG. 8, the clips include a stab portion 74 which is inserted into an opening 75 in a mating clip of an abutting main runner section. The opening is formed by offsetting a portion of the sheet metal clip, as indicated at 76. A catch 78 near the end of the stab portion 74 acts to lock the clip in place when it is inserted in the opening 75 of the corresponding clip on the abutting main runner section. The offset portion extends through the opening in the web of the associated runner to receive a clip on the opposite side of the web.

The cross-runner members and the manner in which they are assembled into a grid framework is shown in FIGS. 4 – 7. The cross-members, which may be in either 2 feet or 4 feet lengths, have integral preformed connector tabs 80 on each end. The 4 feet cross-members also have a rectangular opening 82 in the web at the center.

Figure 5:
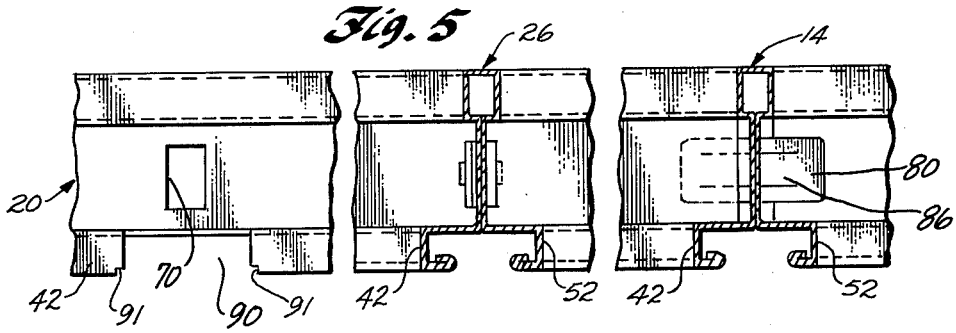
FIG. 5 is an assembly side view, partly in section, of cross-members with each other and with a runner.
Figure 6:
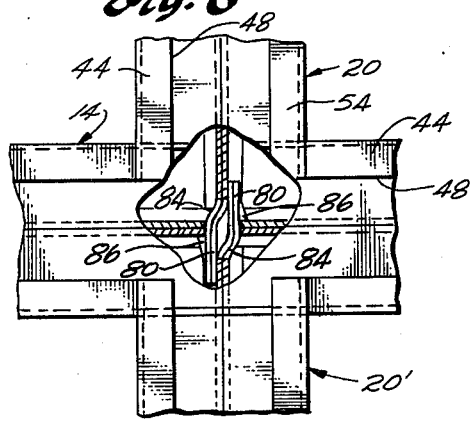
FIG. 6 is an assembly bottom view, partly in section, of intersecting members.

The manner in which the ends of the cross-members lock into the main runners is shown in FIGS. 5, 6, and 7. The tab 80 which is integral with the web 34 is offset at 84 by an amount equal to the thickness of the web, i.e., twice the thickness of the sheet steel strip from which the structural members are formed. The rectangular openings 70 and 82, which receive the tabs 80, have a width equal to three times the thickness of the web. Thus when the tabs 80 of two cross-members are inserted into the opening 70 from either side of the main runner, the tabs 80 hold the webs of the cross-members in alignment in the same plane, as shown in FIG. 6. The tabs 80 are locked in place by integral fingers 86 which are offset from the tabs 80. The fingers have sufficient spring so that the ends snap outwardly after passing through the opening 70 and thus prevent the tabs from being withdrawn after they are inserted.

When assembled, the hollow rectangular bulb portion 30 of the cross-members 20 and 20' terminates in abutting relation to the sides of the bulb portion of the main runner 14. The legs 42 and 52 of the L-shaped portions 36 and 38 of the cross-members terminate in abutting relation to the outside surface of the corresponding leg 42 on one side of the main runner and in abutting relation to the outside surface of leg 52 on the opposite side of the main runner. A notch 90 is formed in the legs 42 and 52 of the main runner just below the opening 70. The width of the notch is the same as the distance between the inside surfaces of the legs 42 and 52. The corners of the notch 90 are relieved at 91 to permit extensions of the lips 44 and 54 of the cross-members to extend to the inner margins of the lips of the runner. The inwardly directed lips 44 and 54 of the cross-members extend beyond the notched edges 92 of the associated legs so as to terminate in alignment with the inner edge 48 of the lip 44 of the main runner when in assembled position. Thus when completely assembled, a tight interlocking connection is formed which prevents twisting or rotation of the cross-members relative to the main runners.

What is claimed is:

1. A drop ceiling comprising a plurality of longitudinal frame members, each member being formed from a single flat sheet metal strip, each member being formed in cross-section with a rectangular shaped hollow tubular portion, a flat web portion in the form of two thicknesses of sheet metal strip projecting from the center of one side of the tubular portion, and a pair of L-shaped portions each having one horizontal leg extending outwardly from a side of said flat web portion opposite from the other horizontal leg, and a vertical leg extending parallel to but in the opposite direction from said flat web portion to form a channel-shaped portion, the outer margins of the channel-shaped portion having folded lips projecting inwardly toward each other, the lateral extent of the outwardly extending horizontal legs being substantially greater than the lateral width of the tubular portion, and means for joining the frame members in a rectangular open network, the intersections of the frame members being formed by connecting the ends of two frame members to opposite sides of a third member to form a pair of T-joints at spaced intervals along the third member, the third member having the parallel vertical legs and associated folded lips of the two L-portions notched at each intersection with the adjoining two members, each of the adjoining members at an intersection having the folded lips projecting beyond the ends of the associated L-shaped portions so as to fit between the notched edges of the adjoining folded lips of the third member with the ends of the associated L-shaped portions abutting edgewise against the sides of the parallel vertical legs of the third member at the margins of the notches in the parallel vertical legs of the third member, each of the two frame members being terminated in a connector tab formed extending and offsetting a portion of the two thicknesses of the web longitudinally beyond the rectangular portion and the L-shaped portions, the tab extending parallel to but offset from the longitudinal major surfaces of the associated flat web portion, the connector tabs of said two frame members extending through an opening in the flat web portion of the third member from opposite sides in overlapping relationship, the tabs having intergral fingers projecting from the tab and engaging the flat web portion adjacent the opening to lock the members together, and panels supported in the rectangular openings of the framework the margins of the panels being notched to receive the L-shaped portions so that the panels are supported on the outwardly projecting horizontal legs of the L-shaped portions and the outer surface of the panels is flush with the folded lips.

2. The apparatus of claim 1 wherein the inwardly turned edges of each frame member are doubled over to double the thickness and form a rounded inner margin.

3. The apparatus of claim 1 wherein the sheet metal strip is coated before being rolled in shape with a layer of material providing contrasting shades of color on opposite surfaces of the strip.

* * * * *